United States Patent [19]

Carty et al.

[11] 3,998,122

[45] Dec. 21, 1976

[54] ELECTRO-PNEUMATIC ACTION FOR PLAYER PIANO

[76] Inventors: Richard L. Carty, 408 The Strand, Manhattan Beach, Calif. 90266; Iver F. Becklund, 1772 Curtis Ave., Manhattan Beach, Calif. 90026

[22] Filed: Apr. 28, 1975

[21] Appl. No.: 572,468

[52] U.S. Cl. ..... 84/125

[51] Int. Cl.[2] ..... G10F 5/06

[58] Field of Search ..... 84/122–127, 84/140–141, 133

[56] References Cited

UNITED STATES PATENTS

| | | | |
|---|---|---|---|
| 1,599,394 | 9/1926 | Cheek | 84/123 |
| 1,648,840 | 11/1927 | Clark | 84/123 |
| 1,788,561 | 1/1931 | Boettcher | 84/122 |
| 3,117,481 | 1/1964 | Cushing | 84/123 X |

*Primary Examiner*—Lawrence R. Franklin

[57] ABSTRACT

The specification discloses a player piano action comprising an electric motor, a roll drive, and vacuum actuated automatic transmission which incorporates a traveling cylindrical housing to operatively engage and disengage the take-up and rewind spools. The action incorporates a pneumatic stack which is constructed to permit access to all bleed holes without disassembly. The vacuum for actuating the notes is supplied via a foot pump which is hinge mounted to facilitate repair of and access to the piano action.

7 Claims, 14 Drawing Figures

FIG. 11.
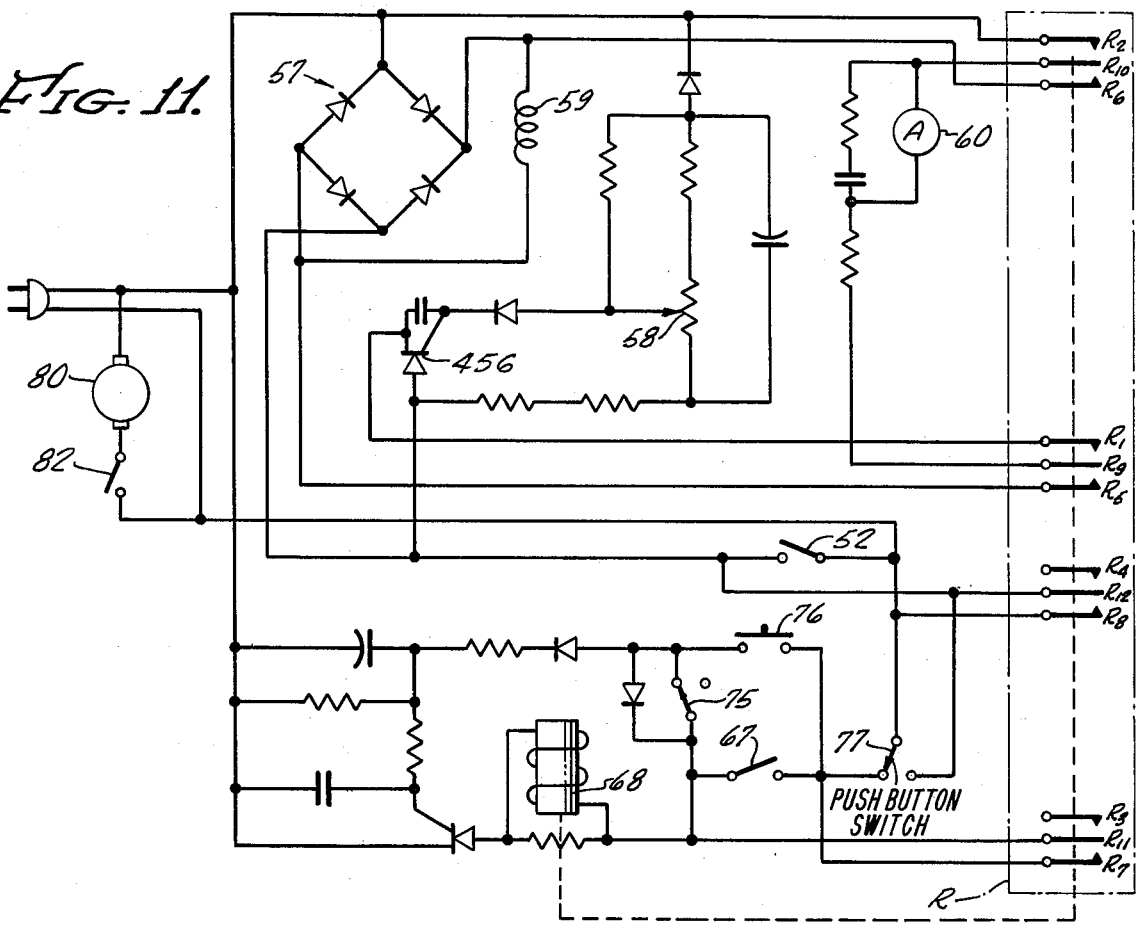
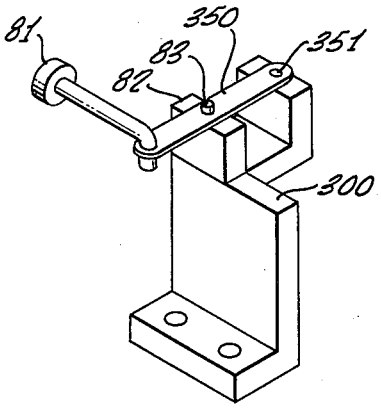
FIG. 12.
FIG. 13.
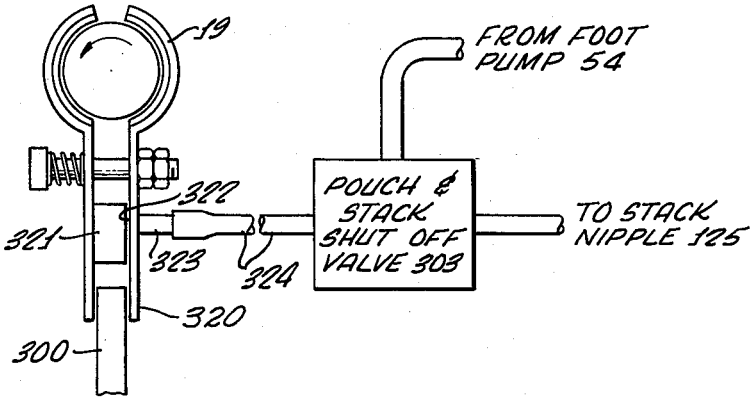
FIG. 14.
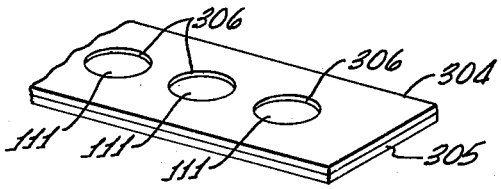

ELECTRO-PNEUMATIC ACTION FOR PLAYER PIANO

BACKGROUND OF THE INVENTION

1. Description of the Prior Art

Reference is made to U.S. Pat. No. 1,788,561 by A. H. Boettcher dated Jan. 13, 1931 which shows a player piano employing an electric motor roll drive, and application Ser. No. 465,305 filed Apr. 29, 1974 by Luther S. Joy which shows and claims an electro- pneumatic player piano employing a semi-automatic transmission.

2. Field of the Invention

In recent years the popularity of player pianos has increased to the point where "rebuilders" are no longer able to acquire a sufficient number of old pianos to meet demands. As a consequence several companies have investigated the feasibility of building player actions for modern pianos. A paramount problem with such an undertaking lies in the fact that the conventional player action occupies a large volume within the piano case. It is therefore not possible to incorporate such units in modern small case spinet pianos. In addition to their bulkiness, the traditional player action requires considerable pumping effort. Moreover, the large vacuum reserve which was required for smooth continuous operation of the air motor and pneumatics produced a long time constant for the vacuum system. This resulted in a consequent decrease in the expression capabilities of the action and thus diminished the interactive aspect between human and machine. Another obstacle to the manufacture of a modern player action lies in the tremendous increase in the cost of labor. What is actually desired is a high quality player action which can be profitably built using present day technology and materials, and easily installed within the confines of a modern piano case.

An object of the present invention is to provide an electric motor which is coupled to the roll through a novel transmission which automatically engages and disengages the take-up and rewind spools in response to sensing switches which detect the presence of vacuum as well as the beginning and end of the roll on the take-up spool. In addition, it is desirable that the transmission automatically shift from the play mode to the rewind mode when the end of the roll is detected — and that it automatically shift from the rewind mode to the play mode when the rewind operation is complete. Another object of the invention is to provide for automatic shut off after the transmission has completed its cycle and returned to the play mode.

An ancillary feature of the present invention lies in the connector system which enables the tracker bar vacuum hoses to be quickly connected and disconnected from the pneumatic stack. The entire pneumatic stack can thus be quickly removed for repair, and then reinstalled without disturbing the hose connections.

An additional object of the invention is to provide a manual pneumatic pump for actuating the notes, and an electric motor for operating the roll. Although primarily intended for a manual operation, it is a further object to include a separate vacuum motor for operating the stack if fully automatic play is desired.

Another object of the invention is to provide a pneumatic stack which is designed to permit access to all bleed holes.

Other objects and advantages of the present invention will be obvious from the detailed description of a preferred embodiment given herein below.

SUMMARY OF THE INVENTION

The aforementioned objects are realized by the present invention which comprises a pneumatic stack which may be operated manually by a foot pump or electrically by a vacuum pump, and an electric motor roll drive. The electric motor is coupled to the take-up and re-wind spools via a novel transmission which incorporates a cylindrical housing which is translated by a pin and worm gear arrangement. The worm gear is connected to an electric motor which is driven counterclockwise to translate the cylindrical housing to a first position to engage the take-up spool and clockwise to engage a collar which operates the re-wind spool. Rotation of the cylindrical housing during translation is prevented by a frictional brake which rides against its outer surface. The translational movement of the cylinder is also used to trip various switch mechanisms which (1) disable the pneumatic stack during rewind, and (2) cause the transmission to shift to the play mode and automatically shut off after the re-wind operation is complete. The speed of motor and hence the tempo during the play mode can be varied by controlling the conduction angle of a solid state electronic switch. The pneumatic stack is coupled to the tracker bar via a ported gasket connector which facilitates quick disconnection and reconnection of the vacuum lines.

DESCRIPTION OF THE DRAWINGS

FIG. 11 is a schematic diagram of the electrical circuitry.

FIG. 12 shows a perspective view of the switch tower.

FIG. 13 shows a cross-sectional view of the cylinder brake and stack shut-off arrangement.

FIG. 14 shows an exploded perspective view of the pouch strip.

DETAILED DESCRIPTION OF A PREFERRED EMBODIMENT

Figure 1:
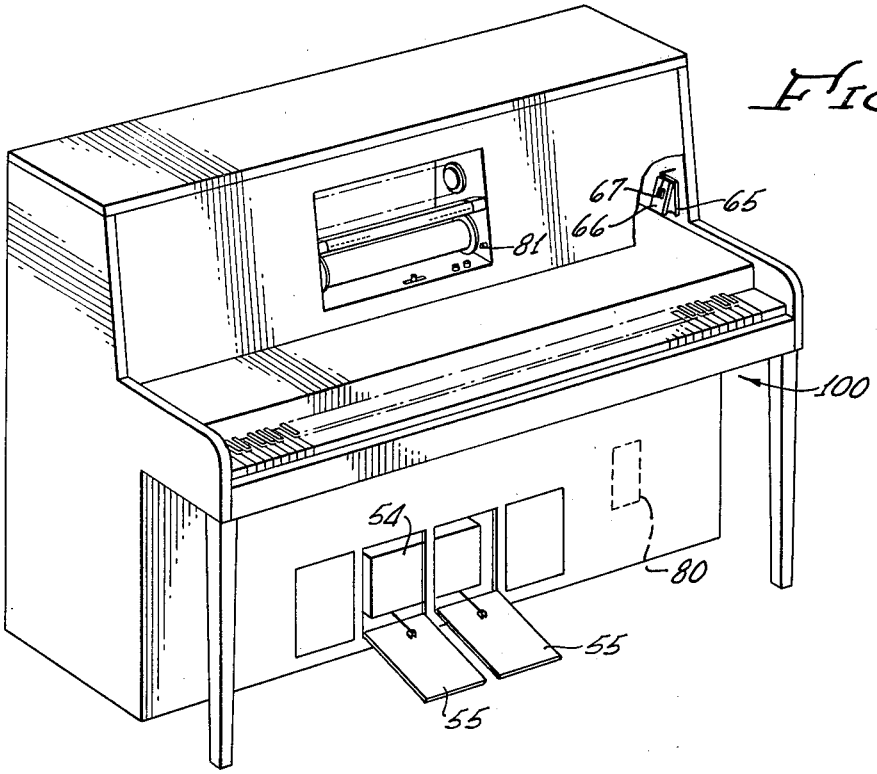
FIG. 1 shows a perspective view of a contemporary piano case which has been modified to incorporate an electropneumatic player action.
Figure 2:
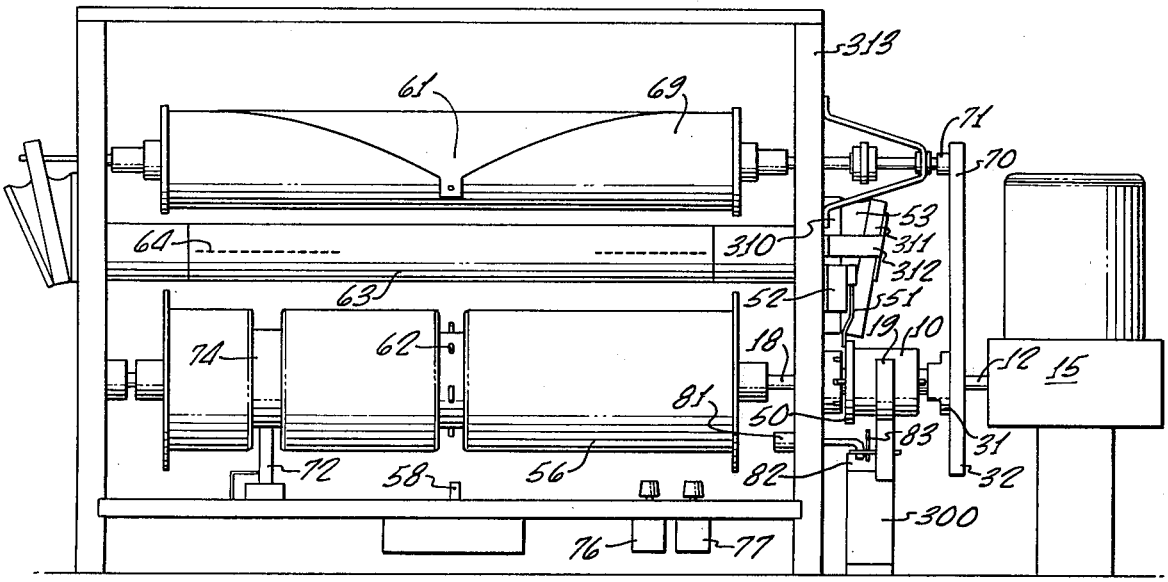
FIG. 2 shows a front elevation of the spool box and transmission.
Figure 3:
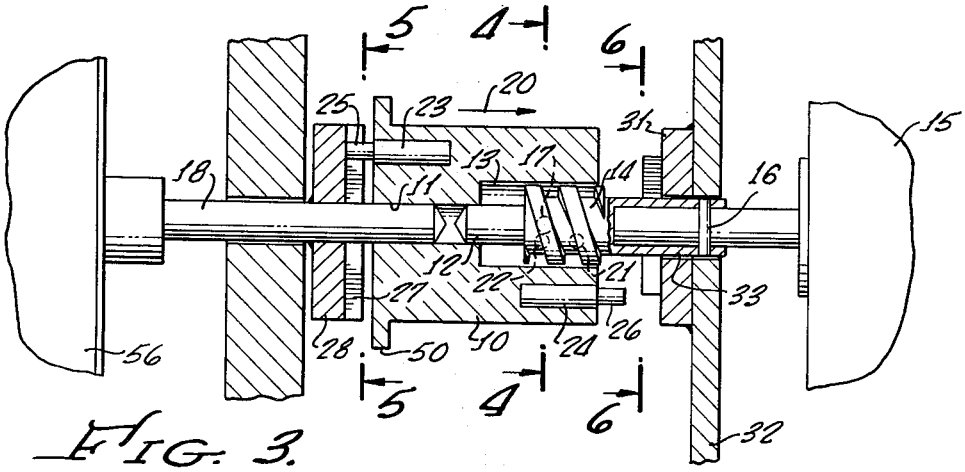
FIG. 3 is a cross section showing the operative elements of the transmission.
Figure 4:
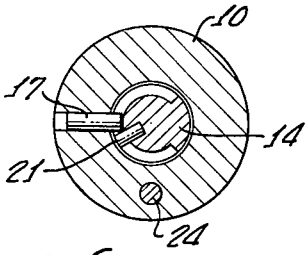
FIG. 4 is a cross section of the transmission taken through the plane 4—4.
Figure 5:
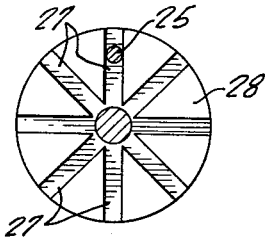
FIG. 5 is a cross section of the transmission taken through the plane 5—5.
Figure 6:
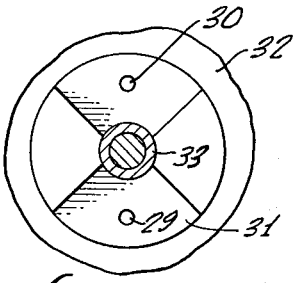
FIG. 6 is a cross section of the transmission taken through the plane 6—6.

The structure and operation of the novel transmission can be understood by referring to FIGS. 1-6 and 11. As shown in FIG. 2, the traveling cylinder 10 has an internal bore 11 at one end of a size sufficient to provide a journal bearing for the cylinder 10 about the axially aligned shafts 12 and 18, and an internal bore 13 at the other end, of a size sufficient to accommodate worm gear 14. The shank 33 of worm gear 14 is attached to shaft 12 by pin 16 so that worm gear 14 and shaft 12 rotate together —clockwise when the electric motor 15 is driven forward and counter-clockwise when the motor 15 is reversed. Coupling between worm gear 14 and traveling cylinder 10 is effected via projecting pin 17 which rides within the trough of the worm gear 14 as indicated. If the force of friction brake 19 against the outer surface of traveling cylinder 10 is sufficient to prevent its rotation, a clockwise rotation of shaft 12 will cause traveling cylinder 10 to move to the right (in the direction of arrow 20) until projecting pin 17 contacts stop pin 21. In a like manner, counterclockwise rotation of shaft 12 causes the frictionally restrained traveling cylinder 10 to translate to the left until projecting pin 17 contacts stop pin 22. After pin 17 contacts either stop pin (21 or 22) the cylinder 10 rotates in unison with shaft 12 —the motor 15 overcoming the frictional force of brake 19.

Each end of the traveling cylinder is bored (holes 23 and 24) to accommodate a spring biased detent pin (25 and 26 respectively). Pin 25 functions to engage one of the recessed channels 27 in the take-up spool coupling hub 28 when the shaft 12 is rotated cunterclockwise, and pin 26 functions to engage one of the holes (29 or 30) in rewind collar 31. It will be understood that coupling hub 28 is attached to shaft 18 so as to rotate therewith, whereas collar 31 is attached to the rewind drive sprocket 32, the latter being journaled on shaft 33 of worm gear 14 so as to freely rotate with respect thereto.

The unique functions performed by the automatic transmission can be understood by referring to the electrical circuitry shown in FIG. 11 in conjunction with the mechanical placement of the switches shown in FIG. 2. In the play mode, traveling cylinder 10 will be at its left most position (as shown in FIG. 2) with detent pin 25 engaging spool coupling hub 28, and flange collar 50 engaging lever arm 51 so as to open play switch 52. Play switch 52 is attached to the movable left leaf 310 of bellows 53 (the right leaf 311 being attached via bracket 312 to the right wall 313 of the spool box). Bellows 53 is coupled to the system pneumatics (as described in detail herein below) via a vacuum line (not shown). When bellows 53 collapses (as a consequence of the vacuum produced by pedalling foot pedals 55) play switch 52 closes, energizing motor 15 (the field 59 via bridge 57 and the armature 60 through relay contacts $R_1$ and $R_9$ by virtue of tempo potentiometer 58 which controls the firing angle of SCR 456 to run in the counterclockwise direction turning take-up spool 56. If the roll 61 has been attached to one of the hooks 62, the rotation of take-up spool 56 will cause the roll 61 to be pulled over the tracker bar 63, and the player piano will be operating in the normal play mode.

After the playing phase is complete, the motor 15 continues to run in the counterclockwise direction until an end-of-roll hole is sensed by a special opening 64 in the tracker bar 63. When the end-of-roll hole passes over tracker bar opening 64 valve 65 is actuated to collapse the rewind pneumatic 66 so as to close rewind switch 67 energizing relay coil 68. Energization of the relay 68 closes three sets of contacts ($R_{11} - R_7$ to maintain a "latched condition" and $R_9 - R_5$ and $R_{10} - Rl_6$ to reverse the motor by applying the output of bridge 57 to armature 60). When this occurs, motor 15 runs clockwise causing traveling cylinder 10 to move to the right; detent pin 25 disengages take-up spool coupling hub 28, and flange collar 50 separates from arm 51 thus closing play switch 52. When detent pin 26 engages one of the holes (29 or 30) in reroll collar 31, reroll spool 69 is driven via sprocket 32, chain 70, and sprocket 71. The rewind mode continues as long as the spring biased spoon valve 72 is prevented (by the presence of the roll 61) from entering the groove 74 in take-up spool 56. When the roll 61 pulls free of its hook (eg. 62), the spoon valve enters groove 74 opening spoon valve switch 75, thus interrupting the current in relay coil 68. the rewind relay R then returns to its original state, (closing contacts $R_2 - R_{10}$ and $R_1 - R_9$) so that the motor 15 again runs in the counterclockwise direction under the control of tempo potentiometer 58. Traveling cylinder 10 moves to the left, detent pin 25 engages a recess 27 of take-up spool coupling hub 28 and flange collar 50 contacts arm 51 opening play switch 52. When play switch 52 opens the cycle is completed, power to the motor 15 is interrupted, and the transmission remains in the standby play mode until vacuum is reapplied (either by foot pump 54 or vacuum motor 80 as described below).

Reroll push button switch 76 and play push button switch 77 enable the operator to transfer from the play mode to the rewind mode and vice versa, at any time. Thus, if the piano is in the "play mode" (or the "standby play mode" following completion of rewind cycle), actuation of push button 76 will energize relay coil 68 and initiate a rewind cycle provided that spoon valve switch 75 is closed (roll attached to take-up spool). Similarly, the latching current in relay coil 68 can be interrupted during rewind causing the rewind relay R to drop out. When this occurs, the system enters the play mode — motor 15 being driven counterclockwise under the control of potentiometer 58 as previously described.

In a preferred embodiment of the invention, provision is also made for operating the pneumatics from a vacuum motor 80 as well as manually (from foot pump 54). In such a system it is desirable to shut off the vacuum motor 80 to prevent the piano from playing during reroll; it is also desirable to prevent vacuum from being applied by the foot pump during reroll (the vacuum produced by the tracker bar tends to pull the roll against its surface — increasing friction and shortening roll life). As shown in FIGS. 12 and 13 both of these functions are accomplished by the movement of the friction brake 19 and traveling cylinder 10 as follows: Assume for example, that knob 81 on vacuum motor switch 82 has been pulled to operate the pneumatic stack 100 from the electric vacuum motor 80, and that the piano has completed the play cycle and shifted into the rewind phase at the end of the roll. Motor 15 will start rotating counter-clockwise so as to cause the articulated friction brake 19 to cock in the same direction. When leaf 320 contacts switch tower 300 gasket 321 separates from the opening 322 of nipple 323 allowing atmospheric pressure to enter line 324. This pressure actuates a pouch which closes stack shut-off valve 303 (the elements of which are identical to the pouch and valve used to actuate the individual notes — described below) thus shutting off vacuum to the pneumatic stack. As the motor continues to rotate, traveling cylinder 10 moves to the right. Flange collar 50 contacts switch arm 83 of vacuum switch 82 thus causing link 350 to rotate about pivot point 351 so as to close switch 82 and return knob 81 to its original off position. Power to the vacuum motor is thus interrupted by the collar 50 prior to the time detent pin 26 engages collar 31.

There are several desirable features associated with the electrical logic which are not readily apparent. Foremost among these is the interrelationship between spoon valve switch 75 and rewind switch 67. As shown in FIG. 11, the rewind switch 67 cannot energize relay coil 68 unless the spoon valve switch 75 is closed. Hence the transmission will not shift into reverse initially (prior to the time at which the roll has been advanced to the point to close the spoon valve) even though the rewind hole is open during this period. A further advantage of the electrical logic lies in the fact that — if at any time power is removed, and then reapplied — the piano will always "come-up" in the standby play mode.

In addition to the unique electrical logic, the transmission has several other features which will be appreciated by those skilled in the art. Of particular importance is its invulnerability to accidental damage. Rolls can be installed, played and removed by inexperienced persons; the transmission can be shifted from the play mode to rewind and vice versa at any time; and the spools can be manually rotated in either direction or physically restrained against the force of the motor 15, all without damage to the apparatus. Such considerations are extremely important to the overall structural efficacy of mechanisms which are likely to be operated by young children.

Figure 8:
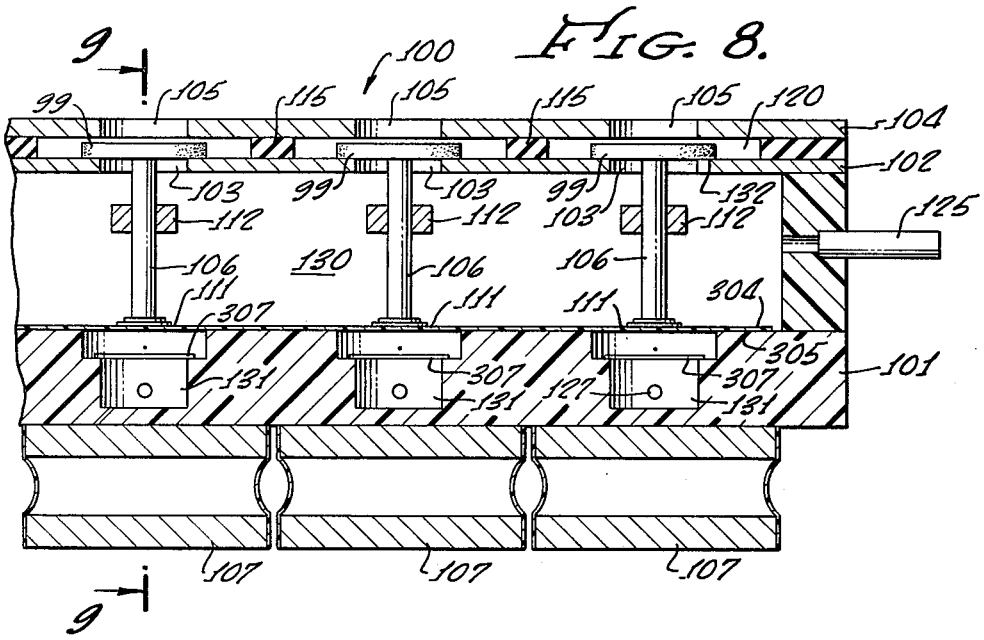
FIG. 8 is a cross sectional view of the pneumatic stack taken through a vertical plane parallel to the piano keyboard.
Figure 9:
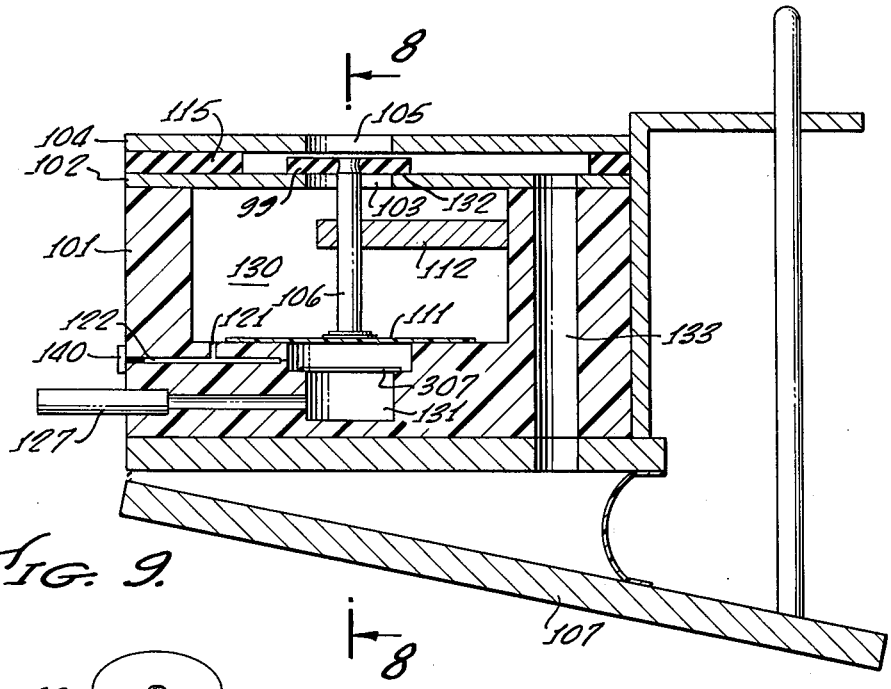
FIG. 9 is a cross section of the pneumatic stack taken through plane 9—9.

FIGS. 8 and 9 show the operative elements of a preferred embodiment of the pneumatic stack 100. The stack 100 comprises a U shaped channel 101 having a plurality of pouch chamber cavities 131, a lower valve plate 102 having a plurality of openings 103 (one for each valve in the stack) an upper valve plate 104 having a plurality of openings 105 (one for each valve in the stack), a valve (comprising an elastically deformable disk 99 and rigid stem 106) for each note to be operated by the stack, and an individual bellows 107 associated with each valve and operated thereby. The stem 106 of each valve rests on a pouch 111, alignment between the valve and seat being maintained by a valve guide 112. As shown in FIG. 14, the pouches 111 are formed in a continuous strip which comprises a layer of paper 304 which is prepunched with a plurality of holes 306 which correspond to the position of the pouch chamber openings 131, which is bonded to a layer of 2 mil. perflex (a trade name of the Union Carbide Co. for polyvinyl chloride). Top valve plate 104 is supported by a 3/32 inch neoprene partition gasket 115 which functions both as a spacer (between plates 102 and 104) and as a means for segregating the area between the plates 102 and 104 into separate valve chambers 120 as indicated. Each pouch is bled via a small bypass 121 which can be cleaned by inserting a wire ramrod through external port 122 (normally covered via a tape 140 to prevent atmosphere leakage into manifold area 130). The housing 101 is preferrably an aluminum extrusion, plates 104 and 102 are preferrably aluminum alloy sheets having a thickness of approx. 0.062 inches. The valve disks 99 are preferrably silicone rubber or other similar material having the desirable properties described in the copending application Ser. No. 465,305 referred to herein above. In order to minimize the probability of fouling the bleed paths as a result of dirt or other contamination "sucked in" through the tracker bar openings, each pouch chamber includes an individual filter 307 (typically a No. 90 mesh brass fabric).

*Although not shown, a 1/32 inch gasket may be imposed between channel 101 and lower valve plate 102 to minimize leakage.

The operation of the pneumatic stack is as follows: Vacuum created by pumping foot pedals 55 (or operating motor 80) is communicated via pipe 125 to the manifold 130 formed by the U shaped housing 101 and plate 102. The lower face 132 of each valve disk 99 normally rests against the lower seat on plate 102 so as to close off the vacuum manifold. When a perforation in the paper roll 61 passes over a hole in the tracker bar 63, atmospheric pressure is admitted to the associated pouch (eg. through nipple 127) upwardly displacing the pouch 111 so as to cause the associated valve disk 99 to lift from its lower seat on plate 102 to an upper seat on plate 104, thus closing off the atmosphere within the valve chamber 120. The vacuum within the manifold 130 is thus transferred via channel 133 to collapse the associate bellows 107. Each bellow is mechanically coupled to a different note (coupling means not shown) which is struck by the collapsing bellow.* After the perforation passes, the tracker bar hole is sealed from the atmosphere and the vacuum on both sides of the pouch is equalized through the bleed 121. Atmospheric pressure on the top of valve disk 99 causes it to return to its original position (lower seat on plate 102) thus removing the vacuum from the bellows.

*In a preferred embodiment, the stack 100 is mounted beneath the keyboard so that the mechanical coupling pushes upward on the rear of the key when the associated bellows is actuated.

Although the operation of the present pneumatic stack is similar to most prior art player pianos, its structure is considerably different. The extruded manifold reduces the mass production fabrication cost and provides increased structural rigidity and stability. It is compact and lightweight thus permitting convenient installation beneath the piano keyboard. Maintenance problems are reduced by providing external access to the bleed path.

Figure 10:
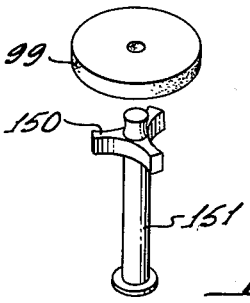
FIG. 10 is a perspective view of an alternate valve stem which does not require a separate valve guide.

FIG. 10 shows an alternative valve embodiment. In lieu of the valve guides 112, advantage is taken of the valve opening 103 by forming each stem 157 with an integral spacer guide 150. The spacer guide 150 slides within the opening 103 so as to maintain the valve alignment with respect thereto. In the particular embodiment shown, the spacer guide 150 has three contact surfaces separated by open areas which permit the vacuum to escape into the valve chamber when the flexible disk 99 is raised from its lower seat on plate 102.

Figure 7:
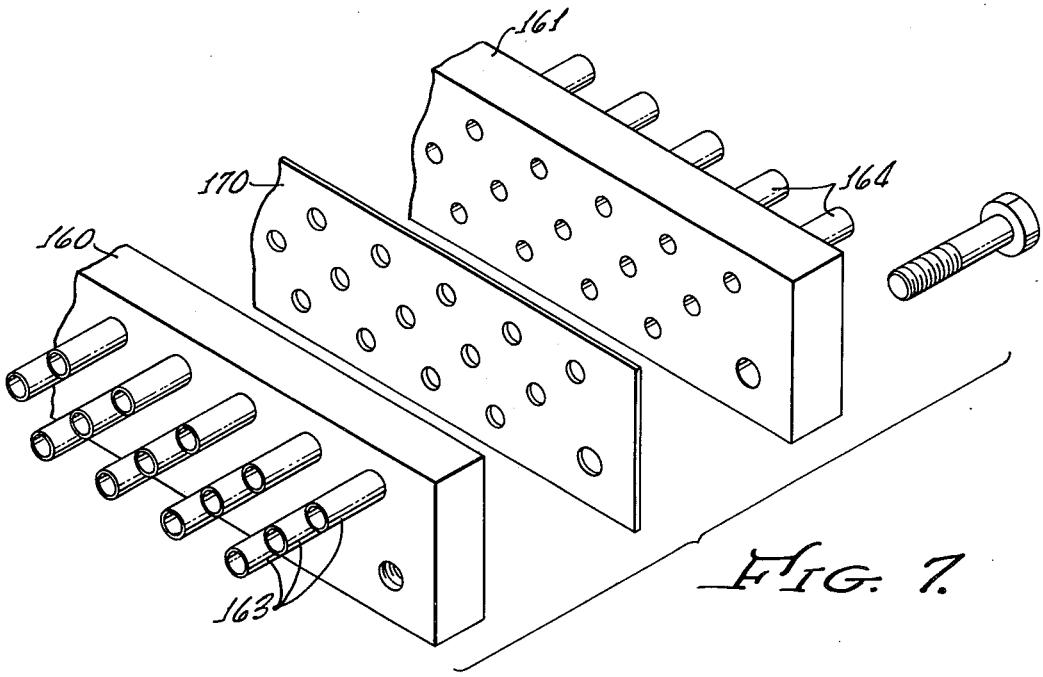
FIG. 7 is an exploded perspective view of the vacuum line connector.

FIG. 7 shows a preferred embodiment of a connector for coupling the pneumatic stack to the tracker bar. The two halves 160 and 161 of the connector are of symetrical construction — each having a plurality (normally 88) of brass nipples (eg. 163) which are axially aligned to communicate with corresponding brass nipples (eg. 164) on the mating portion of the connector. It will be understood however, that contrary to most connectors, the present structure cannot be identified in terms of a male and female couterpart — but rather — each half is neuter gender — coupling of the vacuum from one nipple to its associated nipple being effeced by virtue of the ported gasket 170. The advantages of the connector shown in FIG. 7 will be readily appreciated when compared to prior art connectors which required perfect alignment between the male and female counterparts to effect a vacuum seal. To avoid such costs, most manufacturers connected the vacuum lines from the tracker bar directly to the pneumatic stack. Considerable labor was therefore required to disconnect and reconnect each of the 88 lines to its proper nipple.

Another feature of the present invention lies in the footpump mounting arrangement. Although not shown, the pump is attached to the piano case using four hinges. If pump repair or access to lower piano parts is required, it is only necessary to rotate the pump forward. In summary, the player action is designed to facilitate serviceability — and constructed so as to not require it.

It will be evident that many of the features may be utilized with other player piano designs to improve performance and facilitate construction. For example, the pneumatic stack could be divided into several sections, and each operated at a different vacuum level to provide various degrees of expression. Another possible variation of the basic design is to require that the footpump be operated through a leak valve to maintain vacuum during rewind thus simulating a completely pneumatic system. It will thus be understood that although preferred embodiments and particular combinations have been shown and described, the invention is not limited thereto, and that numerous changes, modifications, and substitutions may be made without departing from the spirit of the invention.

We claim:

1. An electropneumatic player piano action comprising an electric motor having an output shaft;

a spool box including a tracker bar, take-up spool, and journal means for mounting a piano roll on a removable rewind spool;

means for coupling the output shaft of said electric motor to said take-up spool so as to cause said take-up spool to be engaged and rotated when said electric motor is operated in one direction, and;

means for coupling the output shaft of said electric motor to rotate a removable rewind spool when said electric motor is rotated in the opposite direction; and a pneumatic stack;

means for producing a vacuum to operate said pneumatic stack; and wherein said take-up coupling means and said rewind coupling means comprises:

rewind gear means for turning said take-up spool;

a worm gear attached to the output shaft;

a traveling housing having an internal bore sufficient to accommodate said worm gear, and at least one circular exterior cross section;

means for coupling said worm gear to said traveling housing so as to cause said traveling housing to translate in one direction when said electric motor is engaged to rotate clockwise, and in a second opposite direction when said electric motor is engaged to rotate counterclockwise;

take-up spool engaging means attached to one end of said traveling housing for coupling said take-up spool to said electric motor when said electric motor is rotated in a direction to cause said take-up spool engaging means to engage said take-up spool;

rewind spool engaging means attached to the other end of said traveling housing for coupling said rewind gear means to said electric motor when said electric motor is rotated in a direction to cause said rewind spool engaging means to engage said rewind gear means.

2. The apparatus recited in claim 1 and further including:

stop means at each end of said worm gear for limiting the travel of said traveling housing and;

frictional brake means for preventing said traveling housing from rotating when said traveling housing is positioned between said stop means.

3. The apparatus recited in claim 2 and further including:

a flange collar attached to one end of said traveling housing;

a vacuum motor;

vacuum motor switch means for actuating said vacuum motor;

mounting means for positioning said switch in the path of said traveling housing so as to cause said collar to open said vacuum switch when said traveling cylinder moves in a direction to engage said rewind gear.

4. The apparatus recited in claim 3 and further including:

means for shutting off the vacuum to said pneumatic stack.

5. The apparatus recited in claim 4 wherein said frictional brake comprises:

a pair of brake arms each having a circular recessed shoe with a radius commensurate with the circular cross-section of said traveling housing;

spring means for urging said shoes against the surface of the circular cross-section of said traveling housing and;

means for restraining said arms from rotating with said housing.

6. The apparatus recited in claim 5 wherein said means for shutting off the vacuum to said pneumatic stack comprises:

a vacuum port attached to one of said frictional brake arms and;

a gasket attached to the other brake arm, said gasket to be positioned to cover said vacuum port when said brake shoes are urged against the circular cross-section of said housing by said spring means.

7. The apparatus recited in claim 6 wherein is included:

a play switch;

a vacuum sensing pneumatic means for mounting said play switch on said vacuum sensing pneumatic so as to cause said play switch to be opened when said traveling cylindrical housing moves in a direction to engage said take-up spool and, to be closed when said pneumatic is collapsed as a result of vacuum applied by said vacuum producing means.

* * * * *